United States Patent [19]

Daly et al.

[11] Patent Number: 4,610,313

[45] Date of Patent: Sep. 9, 1986

[54] DRILL BIT HAVING A FAILURE INDICATOR

[75] Inventors: Jeffery E. Daly; Paul E. Pastusek, both of Houston, Tex.

[73] Assignee: Reed Tool Company, Houston, Tex.

[21] Appl. No.: 739,884

[22] Filed: May 31, 1985

Related U.S. Application Data

[63] Continuation of Ser. No. 580,502, Feb. 15, 1984, Pat. No. 4,548,280.

[51] Int. Cl.[4] ..... E21B 10/22

[52] U.S. Cl. ..... 175/40; 175/228; 175/337

[58] Field of Search ..... 175/40, 48, 227, 228, 175/337, 339, 371; 73/40, 47, 49.3

[56] References Cited

U.S. PATENT DOCUMENTS

| | | | |
|---|---|---|---|
| 3,853,184 | 12/1974 | McCullough | 175/40 |
| 4,256,189 | 3/1981 | Fox et al. | 175/40 |
| 4,436,164 | 3/1984 | Garner | 175/228 |

FOREIGN PATENT DOCUMENTS

| | | | |
|---|---|---|---|
| 677580 | 1/1964 | Canada | 175/48 |

*Primary Examiner*—Stephen J. Novosad

*Assistant Examiner*—William P. Neuder

*Attorney, Agent, or Firm*—Vinson & Elkins

[57] ABSTRACT

A drill bit comprising a bit body detachably secured to a drill string having a chamber therein to receive drilling fluid at a first pressure from the drill string, a nozzle for exit of the drilling fluid to the space between the bit body and the well bore at a second pressure lower than the first, and a depending leg; a roller cutter; a bearing assembly for rotatably mounting the roller cutter on the leg; a lubrication system in the bit body comprising a reservoir of lubricant, passaging for flow of lubricant from the reservoir to the bearing assembly, a seal member for blocking flow of lubricant out of the bit, an expansible chamber for pressurizing the lubricant to a third pressure greater than the second but less than the first, and a biased diaphragm for pressure compensation secured in a recess in the bit body in fluid communication at one side thereof with the lubricant and at the other side thereof with the drilling fluid in the space between the bit body and the well bore; and a sensor for sensing a decrease in the pressure of the lubricant below a predetermined level and operating to cause a signal indicating the decrease in lubricant pressure to be generated at the drill rig, whereby upon loss of the lubricant in the lubricant system a signal indicating such loss will be provided at the drill rig.

8 Claims, 10 Drawing Figures

DRILL BIT HAVING A FAILURE INDICATOR

This is a continuation of application Ser. No. 580,502 filed Feb. 15, 1984 now U.S. Pat. No. 4,548,280.

BACKGROUND OF THE INVENTION

This invention relates to a rotary drill bit of the so-called sealed bearing roller cutter type used to drill oil and gas wells in the earth, and more particularly to such a bit having a failure indicator feature.

Rotary drill bits of the roller cutter type, such as shown for example in U.S. Pat. No. 3,923,348, are the most commonly used type of drill bits in the oil and gas well drilling industry because they offer satisfactory rates of penetration and useful lives in drilling most commonly encountered formations. Roller cutter drill bits comprise a bit body having a threaded pin at its upper end adapted to be detachably secured to a drill string suspended from a drill rig, and a plurality of depending legs, typically three such legs, at its lower end. The drill bit further comprises a plurality of conical roller cutters having cutting elements thereon, one for each leg, and bearing means for rotatably mounting each roller cutter on its respective leg. Sealed bearing type roller cutter bits further have a lubrication system comprising a reservoir holding a supply of lubricant, passaging in the bit body extending from the reservoir to the bearing means for flow of lubricant to the bearing means, a seal member between the roller cutter and the bearing journal for holding lubricant in the bit and a diaphragm at the reservoir for providing pressure compensation between the lubricant and the drilling fluid in the annulus between the bit and the well bore.

In use, roller cutter drill bits are rotated in the well bore on the end of a drill string which applies a relatively high downward force thereto. As the bits are rotated, the conical roller cutters rotate on the bearing journals, thereby bringing the cutting elements into engagement with the formation at the bottom of the well bore. The cutting elements drill the formation at the well bore bottom by applying high point loads to the formation for causing it to crack or fracture in compression, and may also drill by scraping or dragging across the formation.

For most cost effective drilling, a worn drill bit should be replaced when the increased cost due to the worn bit's reduced rates of drilling penetration as compared to a new bit (i.e., the cost of increased drilling time, which may be $500 per hour and more) becomes equal to the cost of replacing the bit (i.e., the cost of the new bit plus the cost of rig time in tripping the drill string in and out of the well bore). Unfortunately, once a drill bit is positioned in a well bore, it becomes difficult to gather reliable information regarding its operating condition, its performance and its remaining useful life. Typically, the decision by a rig operator to replace a drill bit is a subjective one. He relies on his experience and in some instances also so-called "offset" data showing the performance of similar bits in drilling similar formations to decide when a bit should be replaced. However, because of the many factors affecting drilling performance besides the condition and performance of the bit itself, the rig operator's decision as to when to replace a bit is often not the most cost effective. Even more serious, the rig operator may unknowingly run the bit so long that it fails, perhaps thereby causing the costly problems described hereinafter. Bit failure may also result from an improper application of the bit, such as by excessive weight on the bit, excessive rotational speed and drilling in the wrong kind (i.e., hardness) of formation, as well as a defect in the bit itself.

Bit failures are typically of two modes, namely, (1) breakage of the cutting elements and (2) bearing failure. While the first mode is more common, the second may be more serious. In the first mode, pieces of the cutting elements which are either steel teeth or tungsten carbide inserts are broken from the roller cutters. This breakage significantly reduces the rate of drilling penetration, but the broken pieces are typically carried away from the well bore bottom by the circulating drilling fluid thereby leaving the well bore bottom clean for a replacement bit. In contrast, in the second mode, if the bit is continued to be used with a failed bearing assembly, the assembly will no longer be able to hold the roller cutter on the bearing journal and the roller cutter will fall from the bit when the drill string is pulled from the well bore. A lost roller cutter can be retrieved from the well bore bottom only by a time-consuming (and hence expensive) "fishing" operation, in which a special retrieval tool is tripped in and out of the well bore. In sealed bearing roller cutter bits, bearing failure is often the result of a seal failure which allows lubricant to flow out of the bit and drilling fluid having abrasive particles entrained therein to flow in. Although less common, diaphragm failure has the same result as seal failure. In any event, bearing failure is almost always preceded by or at least accompanied by a loss of lubricant.

Numerous bearing failure indicator systems have been proposed for inclusion in drill bits so as to give the rig operator a signal indicating bearing failure. One such system, shown for example in U.S. Pat. Nos. 3,581,564, 3,703,096 and 3,782,190, involves the measurement and interpretation of certain drilling parameters at the drill rig, such as drill string torque, weight on bit, and rate of penetration, to signal drill bit bearing failure. In practice this sytem has proved to be unreliable. This is likely due to the large number of variables, such as the type of formation and the pressure and flow rate of the drilling fluid, other than bit performance per se which affect the drilling parameters measured at the drill rig.

A second system, such as that shown for example in U.S. Pat. Nos. 3,011,566, 3,678,883 and 3,865,736, involves a marker fluid, such as a radioactive material in the bearing lubricant, which is released into the drilling fluid upon bearing failure. This marker fluid is to be detected at the drill rig when the drilling fluid is circulated back up to the drill rig. While as indicated above, the loss of lubricant in a sealed bearing drill bit precedes or at least accompanies the failure of the bearings of the bit, and thus is a reliable indication of bit failure, this system proved to be unsatisfactory. In addition to the difficulties present in handling radioactive materials, the marker fluid when released into the relatively large volume of drilling fluid was found to become so diluted as to be undetectable.

SUMMARY OF THE INVENTION

Among the several objects of this invention may be noted the provision of a sealed bearing roller cutter drill bit having an improved bearing failure indicator system; the provision of such a system which is reliable in operation, and indicates with certainty bit failure; the provision of such a system which is of simple, economical construction and which may be incorporated into sealed bearing roller cutters of otherwise conventional construction; the provision of such a system which causes a signal to be generated indicating impending bit failure which can be detected with existing gages and measuring instruments on a drill rig; and the provision of such a system which is operable at any drilling depth.

The drill bit means of this invention comprises a bit body having a threaded pin at its upper end adapted to be detachably secured to a drill string suspended from a drill rig for rotating the drill bit means, a chamber therein adapted to receive drilling fluid at a first pressure from the drill string, at least one nozzle at the lower end thereof in flow communication with the chamber for exit of the drilling fluid from the bit body to the space between the bit body and the well bore at a second pressure lower than the first, and at least one depending leg at the lower end thereof having a generally cylindrical bearing journal. The drill bit means further comprises a roller cutter of generally concial shape having a recess therein of generally circular section for receiving the bearing journal and bearing means for rotatably mounting the roller cutter on the bearing journal. A lubrication system is provided in the bit body for providing lubricant to the bearing means. The lubrication system comprises a reservoir holding a supply of lubricant, passaging extending from the reservoir to the bearing means for flow of lubricant to the bearing means, and seal means between the roller cutter and the journal for blocking flow of lubricant out of the bit means. The system further has means for pressurizing the lubricant to a third pressure greater than said second pressure but less than said first pressure, and a diaphragm secured in a recess in the exterior of the bit body in fluid communication at one side thereof, constituting its outer side, with the drilling fluid in said space between the bit body and the well bore and at the other side thereof, constituting its inner side, with the lubricant. The diaphragm has biasing means associated therewith for holding it in equilibrium between said third pressure of the lubricant and said second pressure of the drilling fluid while allowing the diaphragm to extend and contract within a range of movement in response to changes in the volume and pressure of the lubricant held in the lubrication system as may occur during use of the drill bit means. Means is provided in the bit body for sensing a decrease in the pressure of the lubricant in the lubrication system below a predetermined level less than the third pressure. The sensing means is operable to cause a signal indicating said decrease of lubricant pressure below the predetermined level to be generated at the drill rig, whereby upon loss of lubricant such as due to a failure of the seal means and the resultant decrease in the lubricant pressure below the predetermined level, a signal indicating said lubricant loss will be provided at the drill rig.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
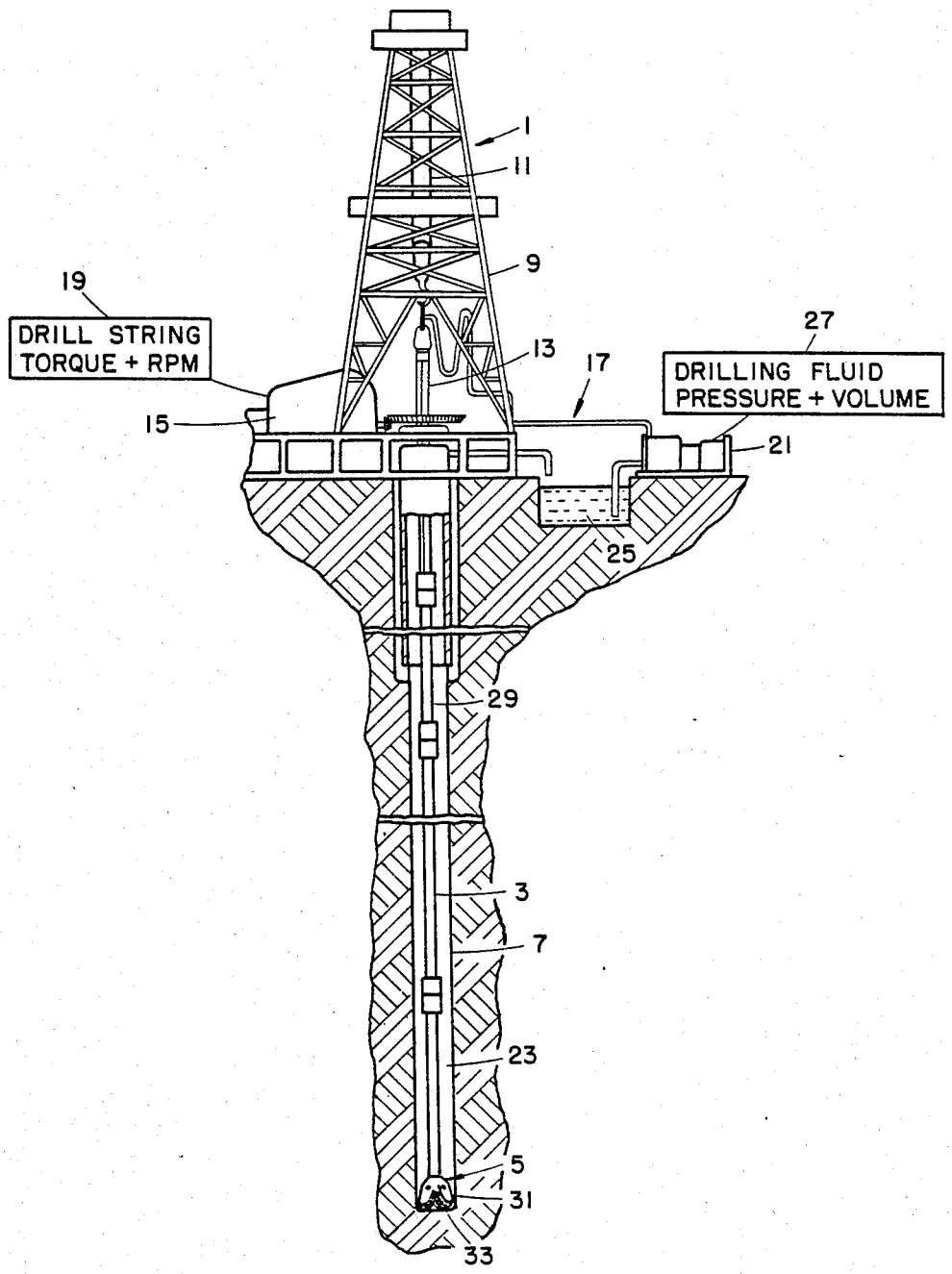
FIG. 1 is a diagramatic view of a drill rig for drilling a well bore using a drill bit of this invention, with the formation shown in section to show the drill bit.

Referring to FIG. 1, there is generally indicated at 1 a drill rig for rotating a drill string 3 having a drill bit 5 at its lower end for drilling a well bore 7 in the earth. The drill rig is of conventional construction comprising a mast 9 for supporting the drill string, a block and tackle arrangement 11 for raising and lowering the drilling string, a kelly 13 for transmitting rotation to the drill string while allowing it to move down during drilling, means 15 for rotating the kelly, and a drilling fluid circulation system 17. The means for rotating comprises a prime mover and power transmission means such as gears and linkages. Gages or other measuring instruments, designated 19, associated with the means for rotating the kelley display the torque applied to the drill string and its speed of rotation. The drilling fluid circulation system 17 includes a pump 21 for pumping drilling fluid at a relatively high pressure down the passage in the drill string 3 and through nozzles in the drill bit 5, and back up the annular space 23 between the drill string and the side wall of the well bore at a relatively low pressure to a reservoir 25 adjacent to the drill rig. Gages and other measuring instruments, designated 27, display the drilling fluid pressure at the pump and the flow rate through the system.

The drill string 3 suspended beneath the drill rig comprises a plurality of lengths of drill pipe or drill collar 29 threaded together in end-to-end relationship. The uppermost length of drill pipe or collar is threaded to the kelly, and the lowermost length of drill pipe or collar has the drill bit 5 or a so-called sub (not shown in FIG. 1 but designated 82 for example in FIG. 4) to which the drill bit is attached. The drill string is used to rotate the drill bit, apply weight to the bit to facilitate drilling, and deliver the drilling fluid under pressure to clean the bottom of well bore, flush cuttings from the bore and cool the bit.

The drill bit of this invention comprises a bit body 31, a plurality of roller cutters 33, bearing means 35 for rotatably mounting the roller cutters on the bit body, a lubrication system 37 for providing lubricant under pressure to the bearing means, and means 39 for sensing a decrease in lubricant pressure operable to cause a signal to be generated at the drill rig indicating such loss in pressure. This signal gives notice to the rig operator that there is insufficient lubricant present at the bearing means and thus that the drill bit should be replaced relatively soon so as to avoid bearing failure and loss of a roller cutter in the well bore. As described more fully hereinafter, this signal is preferably transmitted by a change in drilling fluid pressure or a change in the torque of the drill string. These changes are readable by the rig operator on existing gages (such as gages 19 and 27) on the drill rig. Thus, with no modification to the structure of the drill rig or the standard operating procedure for drilling, a signal reliably indicating bit failure is provided to the rig operator.

Figure 2:
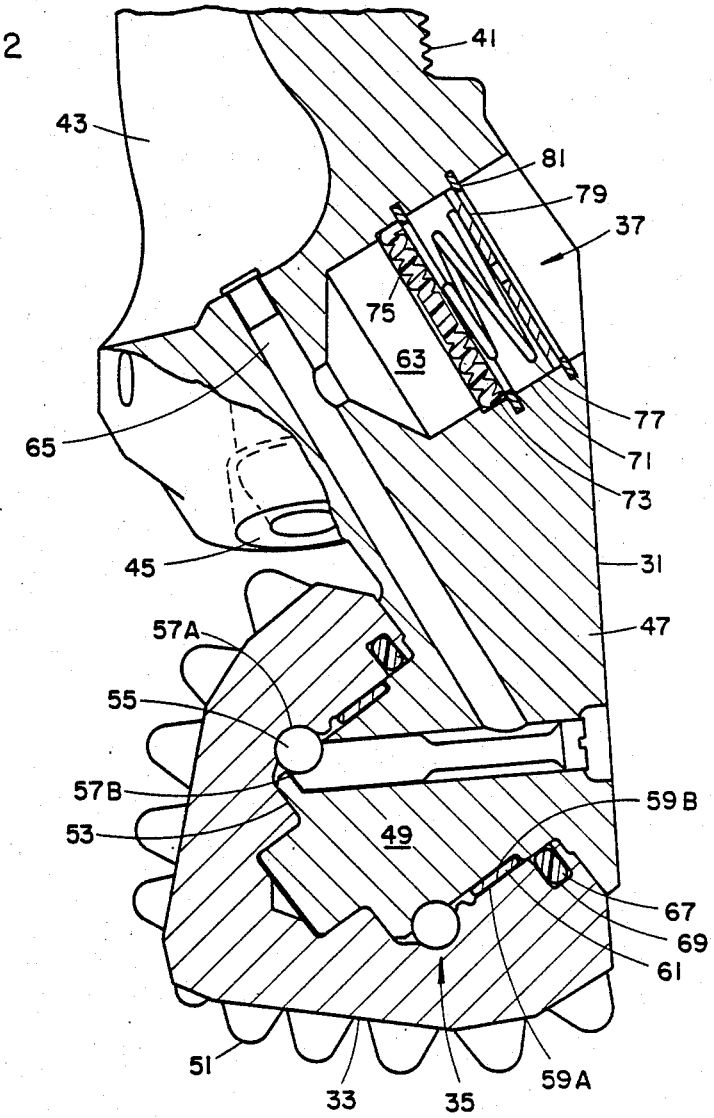
FIG. 2 is an enlarged partial vertical section through the drill bit of FIG. 1 showing a leg, a roller cutter rotatably mounted on the leg, and components of the lubrication system in the bit.

Referring to FIG. 2, the bit body is shown to comprise a threaded pin, a portion of which is shown at 41 in FIG. 2, at its upper end adapted to be detachably secured to the drill string, and a chamber (a portion of which is shown at 43 in FIG. 2) therein adapted to receive drilling fluid at a first and relatively high pressure (up to 10,000 psi and more) from the passage in the drill string. The bit body further has at least one nozzle 45 at the lower end thereof in flow communication with the chamber for exit of the drilling fluid from the bit body to the space 23 between the bit body and the bottom and side walls of the well bore 7. The drilling fluid in the space 23 at the bottom of the well bore is at a second pressure equal to the hydrostatic pressure of the column of drilling fluid in the well bore. This is substantially less than the above-stated first pressure of the drilling fluid. The bit body also comprises a plurality of depending legs, typically three legs, at the lower end thereof, one such leg being shown in section at 47 in FIG. 2. Each leg has a generally cylindrical bearing journal 49 extending inwardly toward the vertical centerline of the bit body. A plurality of the above-noted generally concial roller cutters 33 are mounted on the legs, one for each leg. Each roller cutter has a recess therein of generally circular section receiving the respective bearing journal 49 and a plurality of cutting elements 51 on the outer surface thereof. The cutting elements are either so-called inserts of tungsten carbide secured in bores drilled in the roller cutter as shown in FIG. 2, or integral teeth (not shown) formed by machining the roller cutter.

The bearing means 35 for rotatably mounting the roller cutter on the bearing journal preferably comprises a thrust bearing 53 formed by engageable radically extending surfaces in the recess and on the free end of the bearing journal, balls 55 and ball races 57A and 57B, and annular bearing surfaces 59A and 59B on the roller cutter and bearing journal, respectively, which may be separated by a bushing 61.

The lubricating system 37 comprises a reservoir 63 holding a supply of lubricant, passaging 65 in the bit body extending from the reservoir to the bearing means 35 for flow of lubricant to the bearing means, and seal means comprising an elastomeric ring 67 held in an annular recess 69 in the roller cutter in sealing sliding engagement with the bearing journal for blocking flow of lubricant out of the bit past the bearing means. The reservoir is defined by a recess 71 of generally circular section in the side of the bit body and by a diaphragm 73 extending transversely across the recess. The diaphragm comprises a disc of elastomeric material having a series of annular undulations 75 therein enabling the diaphragm to extend in either direction along the longitudinal axis of the recess without significant stretching of the elastomeric material. A coiled compression spring 77 held in the recess 71 by a vented stop plate 79 and a snap ring 81 carried in an annular recess in the side of the recess, biases the diaphragm to extend inwardly with respect to the recess. The biased diaphragm thus pressurizes the lubricant to a third pressure higher (e.g., approximately 50 psi higher) than the stated second pressure of the drilling fluid in the annular space 23, but lower than the stated first pressure of the drilling fluid. The biased diaphragm maintains the lubricant in the reservoir at the third pressure until the reservoir is substantially depleted of lubricant due to leakage of lubricant from the system.

The diaphragm also provides pressure compensation for the lubrication system by accommodating changes in the stated second pressure of the drilling fluid in the annulus 23 at the bit as the drill bit is raised and lowered in the well bore. It also accommodates changes in the volume and pressure of the lubricant due to heating of the bit during use, and movement of the roller cutter 33 along the longitudinal axis of the bearing journal 49. In this latter regard, the roller cutter, during use of the bit, tends to reciprocate on the bearing journal, thereby alternately increasing and decreasing the volume of the space between the roller cutter 33 and bearing journal 49 holding lubricant. Without pressure compensation, this would result in a pumping action tending to force lubricant out of the bit past the seal means 67. The biased diaphragm 73 thus serves both as means for pressurizing the lubricant and a means for providing pressure compensation.

The above-described construction of the diaphragm 73 and the biasing means 35 is important in enabling fast response to changes in the volume and the pressure of the lubricant at the bearing means so as to hold the lubricant in the lubrication system at or near its stated second pressure. More particularly, the biased diaphragm 73 provides significantly faster response than a piston in sliding, sealing engagement in a cylinder. Such a piston would have an appreciable mass and a static friction force against the wall of the cylinder (i.e., so-called "break-out force") which resists movement of the piston upon a change in the pressure of the lubricant. Moreover, the seal member between the piston and the cylinder would be subject to leakage upon lubricant pressure changes and movement of the piston. In sharp contrast, the mass of the portion of the biased diaphragm 73 subject to movement upon a lubricant pressure change is relatively low, and the diaphragm presents no break-out force which must be overcome. Moreover, the diaphragm 73 which is free of a movable seal member and is protected against damage in the recess 71 by the plate 79, is not susceptible to leakage. In addition, the positioning of the biased diaphragm closely adjacent to the bearing means as shown in FIG. 2 reduces the time required for transmitting changes in the volume and pressure of the lubricant at the bearing means to the diaphragm via passaging 65 further enabling fast response.

Figure 3:
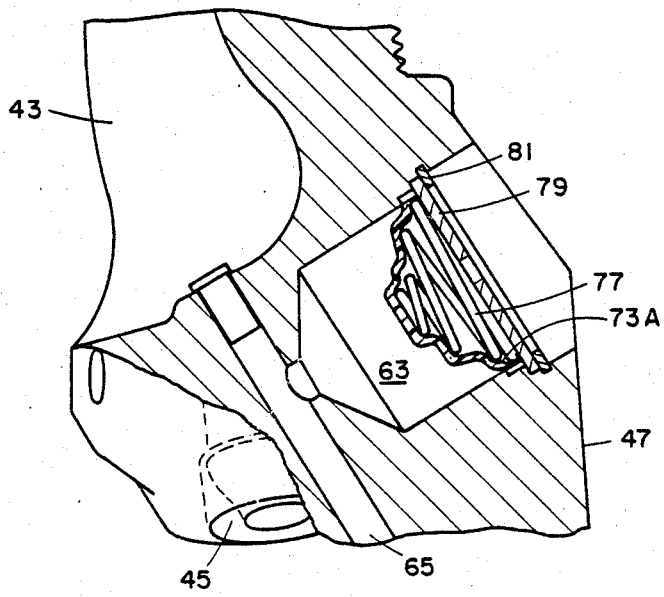
FIG. 3 is a partial vertical section through the drill bit showing an alternative construction of a biased diaphragm of the lubrication system.

An alternative construction of the biased diaphragn is shown at 73A in FIG. 3. This diaphragm is similar to the biased diaphragm 73 of FIG. 2 except it comprises a disc of elastomeric sheet material secured to the spring 77 to form an integral member. The disc is so sized relative to the spring that with the spring compressed the disc is rucked between turns of the spring 73 and with the spring extended the disc is pulled taut into a generally conical shape. While not shown in the Figs., it is contemplated that means other than a spring may be used to bias the diaphragm 73, such as an inflatable bladder holding a liquid under pressure or elastomeric tension members formed in the diaphragm.

Figure 4:
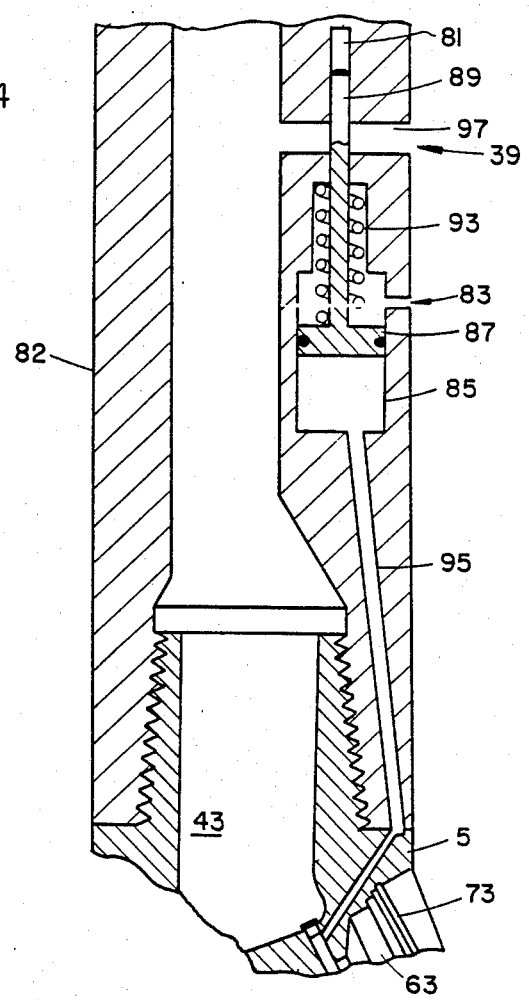
FIG. 4 is a partial vertical section through the drill bit and a so-called sub secured thereto having a reservoir holding lubricant, means for pressurizing the lubricant, and means for sensing a decrease in the pressure of the lubricant.

Referring to FIG. 4, a sub 82 for the drill bit 5 is shown secured to the bit. The sub is a generally tubular member and has a second means 83 for pressuring the lubricant. This second means comprises an expansible chamber 85 holding lubricant and having a piston 87 in communication at one side thereof, constituting the exterior of the chamber, with the drilling fluid in the annulus 23 and at its other side, constituting the interior of the chamber, with the lubricant. The piston has a rod 89 thereon received in a bore 91 in axial alignment with the chamber 85, the rod and bore serving as a guide and guideway for the piston as it moves in the chamber. A coiled compression spring 93 carried on the rod and received in a counterbore in the sub biases the piston into pressurized engagement with the lubricant. Passaging 95 in the sub and the drill bit 5 provide flow communication between the expansible chamber 85 and the reservoir 63 in the drill bit 5. While the expansible chamber is preferably positioned in the sub so as to provide added space for holding additional lubricant for the lubrication system, it is contemplated that the expansible chamber may also be located in the drill bit 5.

FIG. 4 also shows the first embodiment of the sensing means 39 to comprise the piston rod 89 which functions as a movable valve member, and a port 97 extending through the sidewall of the sub. The port is thus in fluid communication with the chamber 43 in the bit body and the annular space 23. The piston rod blocks and unblocks flow of drilling fluid through the port, with the rod being biased by the spring 93 to an open position and being held in a closed position against the bias by the lubricant when at its third pressure. The piston rod moves to the open position when the lubricant pressure drops below a predetermined level less than its stated third pressure, as may occur when lubricant leaks past the seal means and the supply of lubricant in the expansible chamber is depleted. When the port 97 is opened, the drilling fluid in the drill string is exposed to a relatively large cross sectional area exit port as compared to the nozzle ports and the pressure of the drilling fluid in the drill string decreases significantly, while the flow rate of the drilling fluid increases. Both of these changes are reflected at the pressure and flow rate gages 27 of the drilling fluid pump, which are readily readable by the rig operator. Upon seeing such a dramatic increase in flow rate and decrease in pressure, the rig operator will be alerted to the loss in lubricant in the bit and bearing failure.

Figure 5:
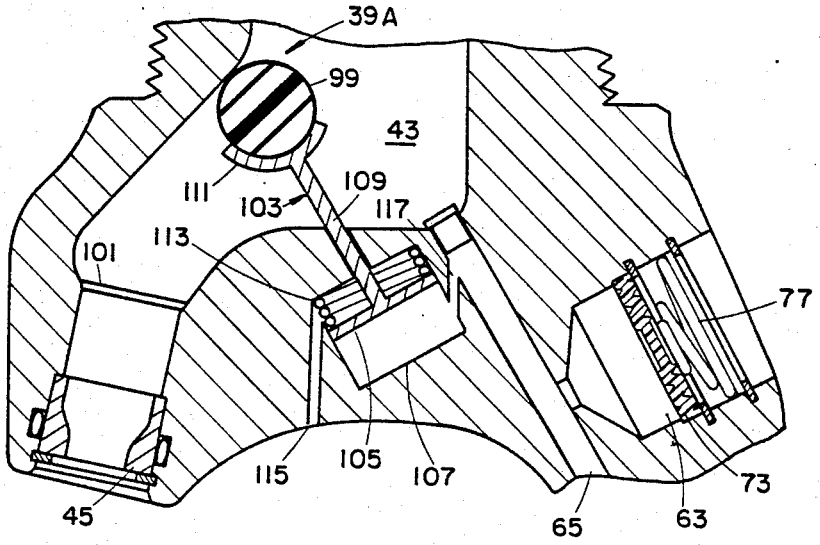
FIG. 5 is a partial vertical section of the drill bit showing a second embodiment of the sensing means having a movable valve member.

A second embodiment 39A of the sensing means is shown in FIG. 5 to comprise a valve in the bit body for blocking and unblocking flow of drilling fluid from the drilling fluid chamber to the nozzle 45. The valve includes a movable valve member comprising a ball or sphere 99 of elastomeric material sealing engageable with a fustoconical valve seat 101 formed in the passageway to the nozzle 45 for blocking fluid flow. The valve further includes means 103 for releasably holding the ball above the valve seat 101 thereby enabling fluid flow. The holding means comprises a piston 105 in a cylinder 107 in the bit body, a rod 109 secured to the piston extending into the chamber 43, and a generally U-shaped support member 111 on the free end of the rod. The rod is movable between an extended position in which it supports the ball 99 above the valve seat 101 and a retracted position in which it releases the ball for movement down the passageway into sealing engagement with the valve seat. The rod is biased to its retracted position by a coil spring 113 carried on the rod at the rod end of the cylinder which is vented to the space 23 by passaging 115. Passaging 117 provides fluid communication between the head end of the cylinder 107 and the reservoir 63, with the lubricant holding the piston rod in extended position when the lubricant is at its third pressure.

In the use of the bit and upon leakage of lubricant past the seal means 67, the lubricant pressure decreases, the rod 109 moves to its retracted position and the ball 99 moves into sealing engagement with the valve seat 101. This engagement blocks flow of drilling fluid through the nozzle 45 and thus the drilling fluid in the chamber 43 may exit the bit body only via the remaining nozzles, thereby increasing its pressure and decreasing its flow rate. These changes in fluid pressure and flow rate are registered on the fluid pump gages 27 readable by the rig operator, thereby giving him a signal that the bit has suffered a loss of lubricant and should be replaced.

Figure 7:
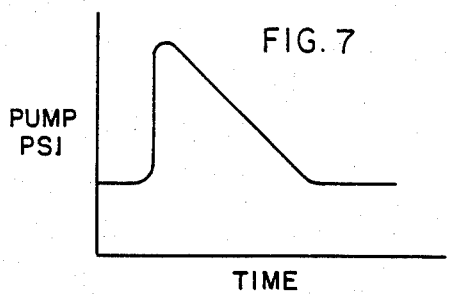
FIG. 7 is a graphical representation of the hydraulic pressure of the drilling fluid at the drilling fluid pump as a function of time with the movable valve member of FIG. 6 in fluid blocking position.
Figure 6:
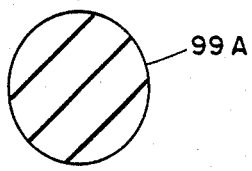
FIG. 6 is an elevation of an alternative construction of the movable valve member.

An alternative construction of the movable valve member is shown at 99A in FIG. 6. The valve member 99A is generally similar to the ball 99 except that it is of slightly non-sperical shape so as to not form a complete sealing engagement with the conical valve seat 101, and is formed of a material subject to fluid erosion, such as a low-carbon steel. Thus, in contrast to the ball 99 which completely blocks fluid flow through the nozzle 43 when in engagement with the valve seat, the valve member 99A allows some flow through the nozzle. Moreover as the valve member 99A is eroded by the fluid flowing past it, the flow rate increases, with the flow rate returning to near normal over time. This unique change in drilling fluid pressure is represented graphically in FIG. 7 showing pump pressure (or psi) as a function of time.

Figure 8:
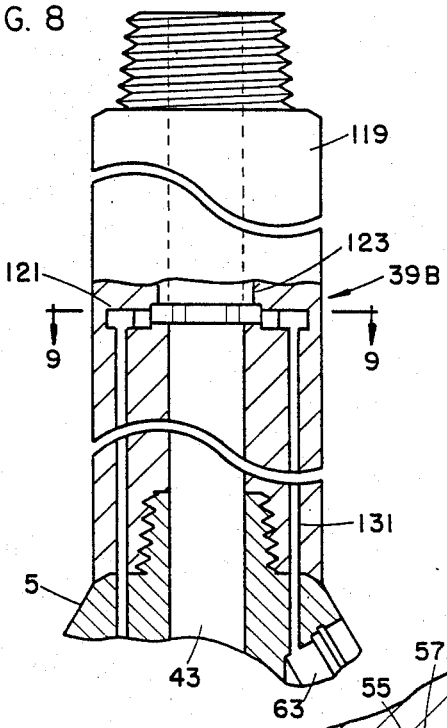
FIG. 8 is an elevation of a portion of the drill bit and a sub for selectively securing the drill bit to a drill string for rotation, the sub having a third embodiment of the sensing means.
Figure 9:
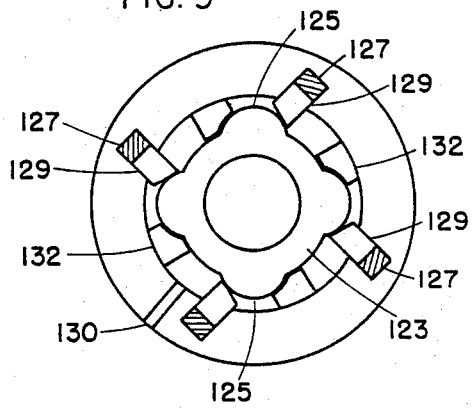
FIG. 9 is a horizontal section on line 9—9 of FIG. 8 showing details of the third embodiment of the sensing means.

FIGS. 8 and 9 show a third embodiment 39B of the sensing means. Like the first and second embodiments 39 and 39A, this embodiment is actuated by lubricant pressure, and more particularly a loss of pressure due to lubricant leakage. However, in contrast to the first and second embodiments, the signal indicating lubricant loss provided to the rig operator is not transmitted via changes in drill fluid pressure but rather via changes in the speed of rotation and the torque applied to the drill string.

More particularly, FIGS. 8 and 9 shows a sub 119 positioned between the bottom of the drill string (not shown) and the top of the drill bit 5 having means 121 for selectively securing the drill bit to the drill string for rotation therewith. The securing means 121 comprises a shaft 123 mounted on a tubular member having a threaded pin at its upper end for threaded engagement with the drill string, and has a plurality of generally radially extending lobes 125, constituting fixed lock members, at its lower end. The securing means further comprises a recess of generally circular section in a lower tubular member having a threaded socket at its lower end for threaded engagement with the drill bit. The recess is positioned at the upper end of this latter tubular member and has a plurality of generally radially extending bores 127 in the side wall thereof, one bore for each lobe. A dog 129, constituting a movable lock member, is positioned in each bore 127 for sliding movement between an extended position in which it engages a lobe 125 and a retracted position in which it is spaced outwardly of the lobes. The engaging surfaces of the lobes and dogs are so shaped as to bias the dogs to their retracted positions when torque is applies to the sub as during drilling operations. Passaging 131 in the lower tubular member provides fluid communication between the bores 127 and the reservoir 63 in the bit body. The lubricant when at its third pressure holds the dogs 129 in engagement with the lobes 125, thereby preventing relative rotation between the drill string and the drill bit. Passaging 130 is provided in the side of the lower tubular member to vent the recess. Shear pins 132 in the recess secure the upper and lower tubular members together during normal handling, but are sheared from the wall of the recess when the sub is subjected to a high torque load.

During use of the drill bit when leakage of the lubricant occurs, the lubricant pressure decreases, the dogs 129 are forced back to their retracted position, the shear pins 132 are broken and the drill string allowed to rotate relative to the drill bit 5. The drill string thus rotates at a higher speed and carries less torque than when the drill bit rotates with it. These changes in speed of rotation and torque are registered in gages 19 readable by the rig operator, thereby giving him a signal that lubricant has been lost and the drill bit should be replaced.

Figure 10:
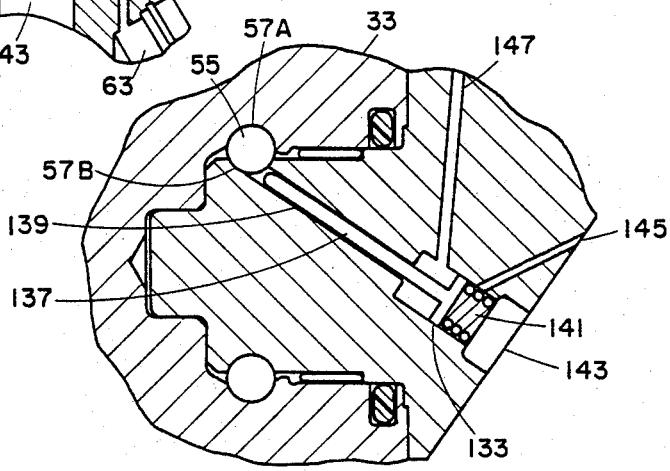
FIG. 10 is a partial vertical section of the drill bit showing a fourth embodiment of the sensing means.

Referring to FIG. 10, a fourth embodiment 39C of the sensing means is shown to comprise a piston 133 and associated cylinder in the bearing journal. A rod 137 secured to the piston, constituting a stop member, is received in a bore 139 extending from the cylinder to the ball races. The rod is movable between an extended position in which it projects into the ball races 57A and 57B and blocks circulation of the balls 55 around the races, and a retracted position in which it is spaced from the ball races.

A coil spring 141 in the head end of the cylinder engageable with the piston and a plug 143 closing the cylinder biases the piston rod 137 to its extended position. Passaging 145 vents the head end of the cylinder to the space 23. Passaging 147 in the bit body provides fluid communication between the rod end of the cylinder and the reservoir 63. The lubricant when at its third pressure holds the piston rod 137 in its retracted position against the bias. During use of the drill bit when leakage of the lubricant occurs, the lubricant pressure decreases, the piston rod 137 moves to its extended position and the rod prevents circulation of the balls 55 in the ball races 57A and 57B. This lack of circulation over time results in the roller cutter 33 becoming affixed in place on the bearing journal 49. With the roller cutter no longer free to rotate, the torque required to rotate the drill string increases while its speed of rotation decreases. These changes are registered on the gages 19 at the drill rig, thereby giving the rig operator a signal that the bit has lost lubricant and should be replaced.

As will be observed from the foregoing, the drill bit means of this invention comprises a sealed bearing drill bit 5 having a lubrication system 37 having means for pressuring the lubricant to a third pressure greater than that of the drilling fluid in the annulus 23, a biased diaphragm 73 providing pressure compensation and which may also function as the pressuring means, and means 39A, 39B or 39C for sensing a decrease in the pressure of lubricant to a predetermined level below the third pressure. The sensing means is operable to cause a signal indicating the pressure loss to be generated at the drill rig. The signal gives notice to rig operator that the bit has lost lubricant and should be replaced. While the signal has been disclosed herein as being transmitted by changes in the drilling fluid pressure and rate of flow, or the drill string torque and speed of rotation, which are readable on existing gages on the drill rig, it is contemplated that the signals could be transmitted by other medium, such as an electrical or acoustic signal, and be readable on a receiver or other measuring instruments designed to respond to such signals. Moreover, the term drill bit means as used in the specification and claims includes not only a drill bit per se, but also any combination of a drill bit and a sub or other attachment to the drill bit.

It is noted that a variable volume lubricant chamber or reservoir is formed by diaphragm 73 in the embodiment shown in FIG. 2, by diaphragm 73A in the embodiment of FIG. 3, by a combination of piston 87 and diaphragm 73 in the embodiment of FIG. 4, and by a combination of diaphragm 73 and piston 105 of the embodiment of FIG. 5. A decrease in the volume of the variable volume lubricant chambers or reservoirs in the embodiments of FIGS. 2, 3, 4 and 5 from a loss of lubricant also results in a decrease in lubricant pressure.

As various changes could be made in the above constructions without departing from the scope of the invention, it is intended that all matter contained in the above description or shown in the accompanying drawings shall be interpreted as illustrative and not in a limited sense.

What is claimed is:

1. A lubrication system to indicate a decrease in lubricant volume below a predetermined level in a rotary drill bit having a bit body adapted to receive drilling fluid at a high first pressure from a suspended drill string, and adapted to discharge the drilling fluid therefrom in a void space between the bit body and an associated well bore with the drilling fluid in said space being at a low second pressure; said lubrication system comprising:

a variable volume reservoir for holding a supply of lubricant;

passaging extending from the reservoir to supply lubricant to bearing means carried by said bit body;

annular seal means adjacent said bearing means to block the flow of lubricant from the drill bit;

means forming a surface portion of said variable volume reservoir and movable toward and away from said reservoir to vary the volume thereof;

biasing means continuously urging said surface portion toward said reservoir to pressurize the lubricant in said reservoir to an intermediate third pressure of a value between said first and second pressures of said drilling fluid; and sensing means operatively responsive to a decrease in the volume of the lubricant in the lubrication system below a predetermined level, said sensing means being operable upon a decrease of lubricant volume below the predetermined level to cause a signal to be generated at the associated drilling rig whereby upon loss of lubricant from said reservoir past said seal means resulting from said intermediate third pressure and the resultant decrease in the lubricant volume below the predetermined level, a signal indicating lubricant loss will be provided at the drill rig.

2. The lubrication system as set forth in claim 1 wherein said means forming a surface portion of said variable volume reservoir comprises a diaphragm in fluid communication with the lubricant on one side thereof and in fluid communication with the drilling fluid in said void space on the other side thereof; and a spring against said one side of a diaphragm continuously urges said diaphragm toward said reservoir to pressurize the lubricant in said reservoir to said intermediate third pressure.

3. The lubrication system as set forth in claim 1 wherein said means forming a surface portion of said variable volume reservoir comprises a piston; and a spring continuously urges the piston toward said reservoir to pressurize the lubricant to said intermediate third pressure.

4. A lubrication system as set forth in claim 1 wherein means responsive to a decrease in the volume of the lubricant in the lubrication system below a predetermined level is operable to increase resistance to the flow of drilling fluid from the suspended drill string thereby to increase said high first pressure which is sensed by said sensing means.

5. A lubrication system as set forth in claim 1 wherein means responsive to a decrease in the volume of the lubricant in the lubrication system below a predetermined level is operable to decrease resistance to the flow of drilling fluid from the suspended drill string thereby to decrease said high first pressure which is sensed by said sensing means.

6. A lubrication system to indicate a decrease in lubricant pressure below a predetermined level which results from a loss of lubricant in a rotary drill bit having a bit body adapted to receive drilling fluid at a high first pressure from a suspended drill string, and adapted to discharge the drilling fluid therefrom in a void space between the bit body and an associated well bore with the discharged drilling fluid in said space being at a low second pressure; said lubrication system comprising:

a variable volume reservoir for holding a supply of lubricant;

passaging extending from the reservoir to supply lubricant to bearing means carried by said bit body;

annular seal means adjacent said bearing means to block the flow of lubricant from the drill bit;

means forming a surface portion of said variable volume reservoir and movable toward and away from said reservoir to vary the volume thereof;

biasing means continuously urging said surface portion toward said reservoir to pressurize the lubricant in said reservoir to an intermediate third pressure of a valve between said first and second pressures of said drilling fluid; and means for sensing a decrease in the pressure of the lubricant in the lubrication system below a predetermined level less than said intermediate third pressure, said sensing means being operable to cause a signal indicating said decrease of lubricant pressure below the predetermined level to be generated at the associated drilling rig whereby upon loss of lubricant from said reservoir past said seal means resulting from said intermediate third pressure and the resultant decrease in the lubricant pressure below the predetermined level, a signal indicating lubricant loss will be provided at the drill rig.

7. A lubrication system as set forth in claim 6 wherein said sensing means includes means responsive to a decrease in the pressure of the lubricant in the lubrication system below a predetermined level to increase resistance to the flow of drilling fluid from the suspended drill string thereby to increase said high first pressure which is sensed by said sensing means.

8. A lubrication system as set forth in claim 6 wherein said sensing means includes means responsive to a decrease in the pressure of the lubricant in the lubrication system below a predetermined level to decrease resistance to the flow of drilling fluid from the suspended drill string thereby to decrease said high first pressure which is sensed by said sensing means.

* * * * *